US006848351B1

(12) United States Patent
Davies

(10) Patent No.: US 6,848,351 B1
(45) Date of Patent: Feb. 1, 2005

(54) RIFLE

(76) Inventor: Robert B. Davies, 433 E. McKinley St., Tempe, AZ (US) 85281-1026

( * ) Notice: Subject to any disclaimer, the term of this patent is extended or adjusted under 35 U.S.C. 154(b) by 0 days.

(21) Appl. No.: 10/140,268

(22) Filed: May 7, 2002

(51) Int. Cl.[7] ..... F41A 5/18
(52) U.S. Cl. ..... 89/191.01; 89/198; 89/193
(58) Field of Search ..... 89/193, 191.01, 89/198, 199; 42/1.06

(56) References Cited

U.S. PATENT DOCUMENTS 3,246,567 A * 4/1966 Miller ..... 89/191.02
3,648,562 A * 3/1972 Loeble ..... 89/185
3,650,177 A * 3/1972 Hupp et al. ..... 89/130
3,707,110 A * 12/1972 Alday ..... 89/193
3,848,511 A * 11/1974 Zanoni ..... 89/191.02
3,977,296 A * 8/1976 Silsby et al. ..... 89/198
4,057,003 A * 11/1977 Atchisson ..... 89/138
4,126,080 A * 11/1978 Reynolds ..... 89/199
4,227,439 A * 10/1980 Gillum ..... 89/190
4,244,273 A * 1/1981 Langendorfer, Jr. et al. .. 89/193
4,246,830 A * 1/1981 Krieger ..... 89/179
4,398,448 A * 8/1983 LaFever ..... 89/185
4,505,182 A * 3/1985 Sullivan ..... 89/132
4,558,628 A * 12/1985 Bosshard ..... 89/198
4,729,280 A * 3/1988 Metz ..... 89/43.01
4,774,873 A * 10/1988 Shoales ..... 89/43.01
5,351,598 A * 10/1994 Schuetz ..... 89/185
5,770,814 A * 6/1998 Ealovega ..... 89/131
5,900,577 A * 5/1999 Robinson et al. ..... 89/191.01
5,909,002 A * 6/1999 Atchisson ..... 89/130

FOREIGN PATENT DOCUMENTS

DE 3612098 A1 * 11/1986 ..... F41D/11/12

* cited by examiner

*Primary Examiner*—Michael J. Carone
*Assistant Examiner*—Troy Chambers
(74) *Attorney, Agent, or Firm*—Parsons & Goltry; Robert A. Parsons; Michael W. Goultry

(57) ABSTRACT

A rifle with an upper receiver and a barrel attached to the upper receiver and including a bolt carrier, and operating, buffer, and cooling systems. The operating system includes a cylinder and a piston coupled to receive propelling gases from the barrel. As the piston moves between retracted and extended positions the bolt carrier is moved between closed and open positions. The bolt carrier includes a weight movable within a guide frame between rearward and forward limits. The buffer system includes a compression spring in a tube attached to the upper receiver in abutting engagement with the bolt carrier. A partially fluid filled cylinder is attached to a coil of the spring and includes a piston and shaft. The piston is formed so that fluid in the cylinder restricts movement in one direction and allows free movement in a second direction.

10 Claims, 13 Drawing Sheets

10
12
14
15
16
18
22
54
60
68
69
80

132
126
137
128
140
124
125
144
142
128
125
130
134
136
122
133
129
140
136
129
138
122
125
126
132
133
124

RIFLE

FIELD OF THE INVENTION

This invention relates to firearms.

More particularly, the present invention relates to automatic, semi-automatic and similar types of rifles and specifically to modifications of M16 type rifles.

BACKGROUND OF THE INVENTION

Several problems are prevalent in automatic and semi-automatic rifles, such as the family of M16 rifles. It will be understood that the family of M16 rifles discussed herein includes but is not limited to the Ar10 and 15, M16, M16A1, M16A2, M16A3, M4, M4A1, etc.

One major problem with these rifles is the operation of the rifle by the discharge of propellant gases. In all of these rifles a portion of the propellant gases, after forcing the projectile forward in the barrel, are directed through a tube rearwardly to force the bolt carrier rearwardly so as to eject the spent cartridge. This operation by the propellant gases becomes a problem because the propellant gases are very dirty and therefore dictate scrupulous and frequent cleaning of virtually all parts of the rifle. Even with frequent cleaning jamming can occur during long periods of usage.

Also, there is some demand for a shorter rifle. However, as the length of the rifle is reduced, the passage of the propellant gases to the bolt carrier is reduced in length and the timing of the firing and reloading cycle is changed. That is, time of the firing cycle is reduced slightly or the firing rate is increased. This change in timing or increase in firing rate can seriously affect the ejection of the spent cartridge and the loading of the next cartridge during automatic firing. For example, the increased firing rate, or reduced time of the firing cycle, causes extreme stress on various parts of the mechanism. Specifically, if the unlocking of the bolt lugs from the barrel and extraction of the spent casing is attempted too early in the cycle, pressures within the firing chamber are very high. The high pressure holds the casing within the chamber and can cause the bolt to break, typically at the cam opening. Other weak areas are sealing rings carried by the bolt.

Also, changes in length and firing rates changes the operation of the buffer system so that it does not operate as well. Generally, the buffer system of a rifle is specifically designed to cooperate with the firing mechanism. That is, the buffer system is designed to compress after firing a cartridge and to have sufficient stored energy to cause the bolt carrier to strip a new cartridge from the magazine, insert the cartridge in the barrel, and move the bolt into the locked position in preparation for the next firing cycle. If the firing rate is increased, the timing of the buffer system is not accurately matched to the firing mechanism and jamming or other problems can arise during automatic firing.

It would be highly advantageous, therefore, to remedy the foregoing and other deficiencies inherent in the prior art.

Accordingly, it is an object the present invention to provide a new and improved automatic/semi-automatic rifle.

Another object of the present invention is to provide a new and improved automatic/semi-automatic rifle which is more reliable.

And another object of the present invention is to provide a new and improved automatic/semi-automatic rifle with improved timing in the firing cycle.

Still another object of the present invention is to provide a new and improved automatic/semi-automatic rifle with improved shock absorbing characteristics.

Yet another object of the present invention is to provide a new and improved automatic/semi-automatic rifle with improved cartridge ejection apparatus.

A further object of the present invention is to provide a new and improved automatic/semi-automatic rifle which can be shortened without adversely affecting the timing or operation.

And a further object of the present invention is to provide a new and improved automatic/semi-automatic rifle which includes an improved heat sink so that the rifle can be fired for longer periods without adverse effects.

SUMMARY OF THE INVENTION

Briefly, to achieve the desired objects of the present invention in accordance with a preferred embodiment thereof, provided is a rifle with an upper receiver and a barrel attached to the upper receiver and including any one or all of a modified operating system, a modified bolt carrier, a modified buffer system, and/or a cooling system.

The modified operating system is provided in a rifle having an upper receiver carrying a bolt carrier and a barrel attached to the upper receiver. The operating system includes a piston assembly coupled to the barrel for receiving propelling gasses from the barrel. The piston assembly includes a piston moveable between a retracted position and an extended position. The piston is coupled to the bolt carrier for movement of the bolt carrier from a closed position to an open position as the piston moves from the retracted position to the extended position.

In a preferred and more specific embodiment, the modified operating system includes a piston assembly coupled to the barrel for receiving propelling gasses from the barrel, including a piston moveable between a retracted position and an extended position. A push rod extends along the barrel and has a first end positioned to be engaged by the piston and a second end coupled to the bolt carrier for movement of the bolt carrier from a closed position to an open position as the piston moves from the retracted position to the extended position.

The modified bolt carrier is provided in a rifle having an upper receiver for carrying a bolt carrier and a barrel attached to the upper receiver. The bolt carrier includes a tubular guide frame and a forward portion carrying a bolt. A reciprocating weight is carried within the tubular guide frame for movement between a first position at a rearward limit and a second position at a forward limit.

The modified buffer system is provided in a rifle having an upper receiver carrying a bolt carrier and a barrel attached to the upper receiver, the bolt carrier having a locked position and an open position. The buffer system includes an elongated compression spring positioned in a tubular extension member attached to the lower receiver in axial alignment with the upper receiver so as to be in abutting engagement with the bolt carrier. A partially fluid filled cylinder is fixedly attached to a first coil of the spring. A piston is reciprocally mounted within the cylinder for movement between a first position and a second position, the piston including a connecting shaft which engages a closed end of the extension member when the spring is compressed. The piston is formed so that the fluid in the cylinder restricts movement of the piston toward the first position and allows substantially free movement of the piston toward the second position. The piston is mounted so that compression of the spring by movement of the bolt carrier from the locked position to the open position moves the piston in the cylinder toward the first position and expansion of the spring moves the bolt carrier from the open position to the locked position and moves the piston in the cylinder toward the second position.

A cooling system for the rifle includes an elongated tubular member affixed to the barrel for conveying heat from the barrel to the tubular member and a plurality of parallel, circumferentially extending heat exchanging fins attached to the tubular member. A hand guard is provided to protect an operators hand from the fins.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figures 1, 2:
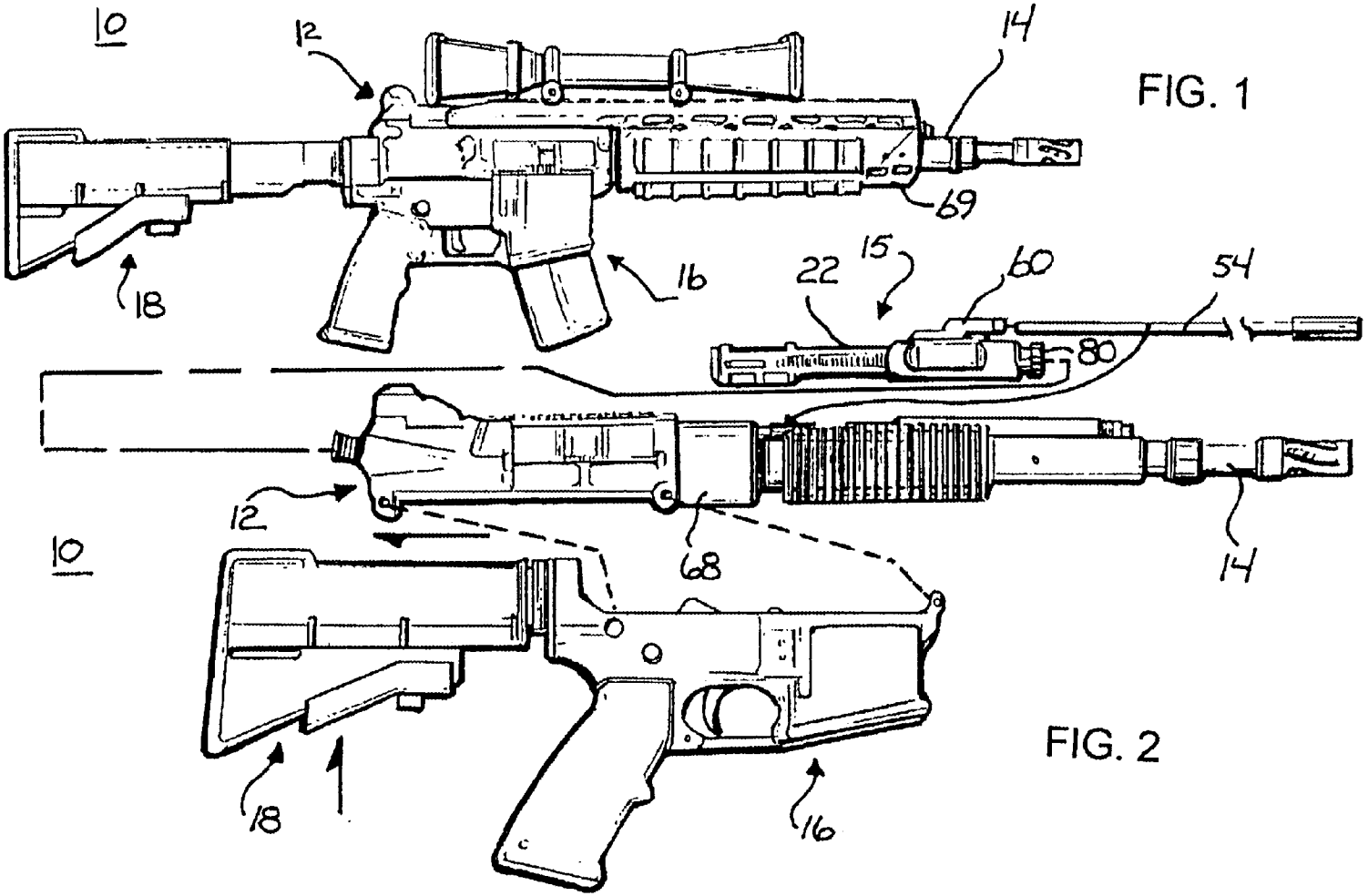
FIG. 1 is a side elevation view of a rifle in accordance with the present invention.
FIG. 2 is a partially exploded side view of the rifle of FIG. 1.

Turning now to the drawings in which like reference characters indicate corresponding elements throughout the several views, attention is directed to FIG. 1 which illustrates a rifle generally designated 10. Rifle 10 is illustrated as an M4 type carbine for purposes of this explanation. However, it should be understood by one skilled in the art that any of the family of M16 rifles can incorporate one or more of the following modifications. It will be understood that the family of M16 rifles includes but is not limited to the Ar10 and 15, M16, M16A1, M16A2, M16A3, M4, M4A1, etc. Furthermore, in specific applications, one or more of the herein described modifications may be used on other rifles.

With additional reference to FIG. 2, general components of rifle 10 include an upper receiver 12, barrel 14, bolt carrier assembly 15, lower receiver 16 and butt stock 18. Various modifications incorporated into rifle 10 include an operating system 20, illustrated more specifically in FIGS. 3–9, a bolt carrier 22, illustrated more specifically in FIGS. 11 and 12, and buffer system 24, illustrated more specifically in FIGS. 18–23.

Figures 3, 7:
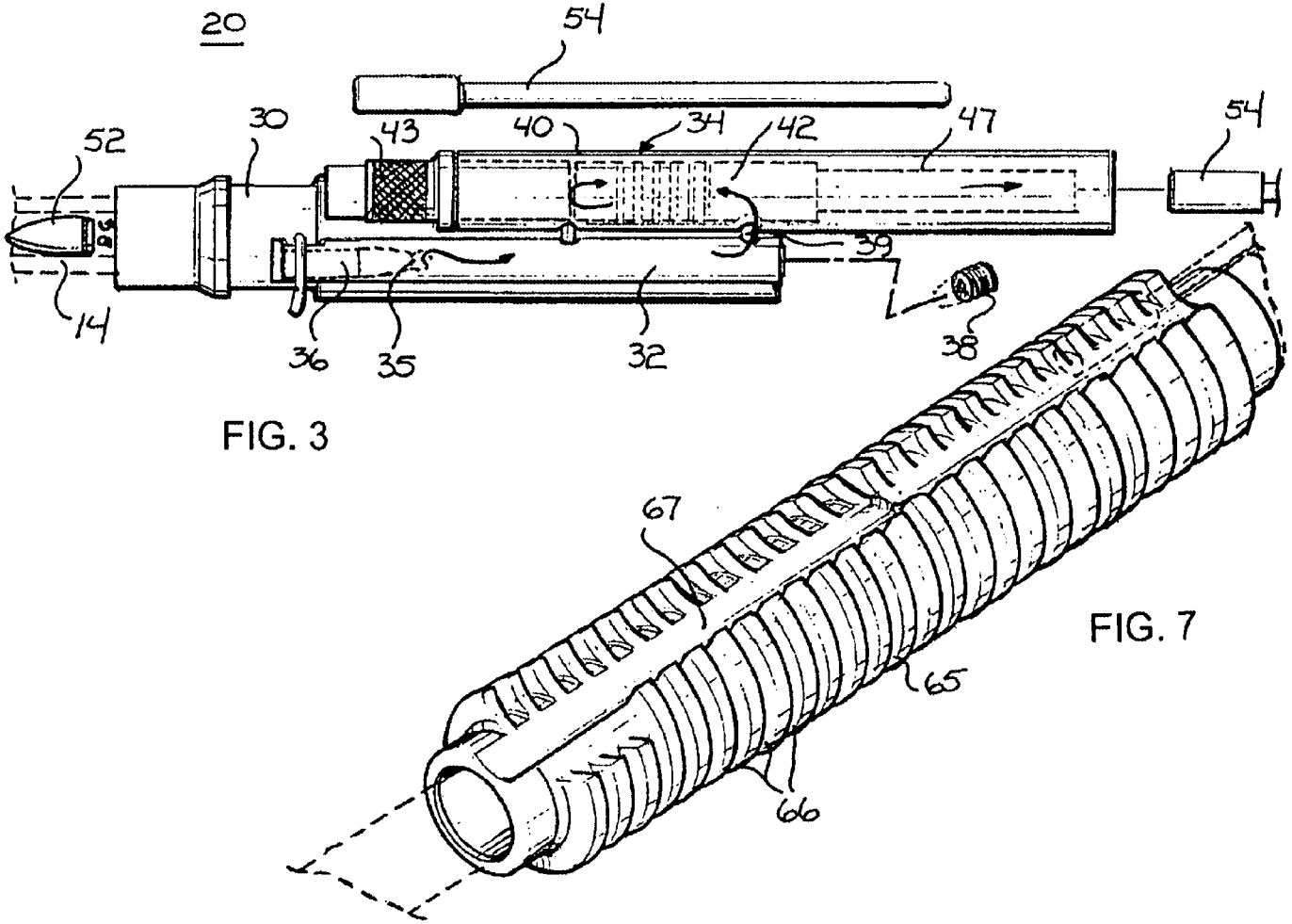
FIG. 3 is a view in top plan of a portion of the rifle of FIG. 1, illustrating an operating system at initiation of a cycle, in accordance with the present invention.
FIG. 7 is an enlarged perspective view of a heat sink according to the present invention.
Figure 4:
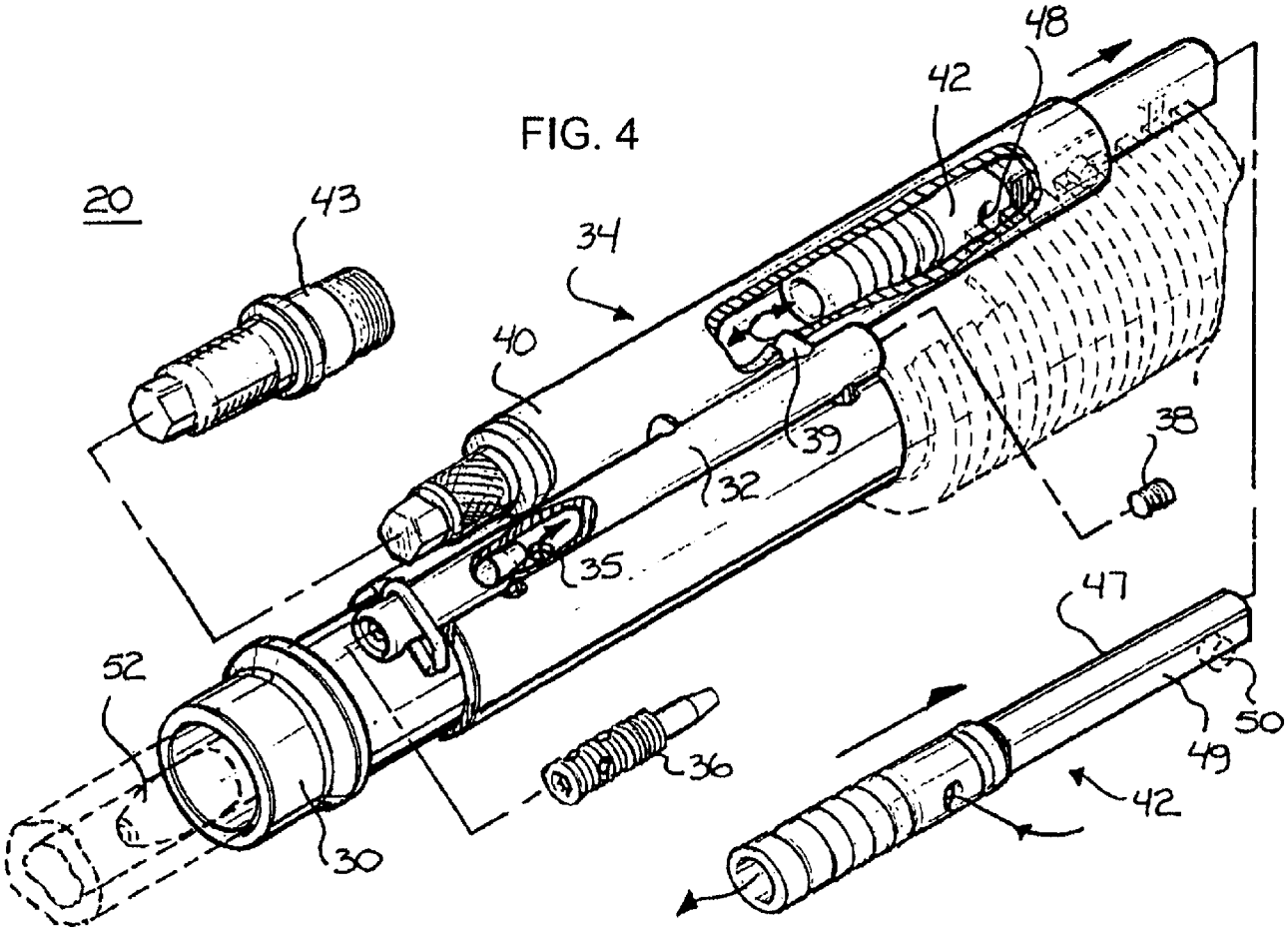
FIG. 4 is an enlarged partially exploded perspective view of a portion of the operating system of FIG. 3, at subsequent position of the cycle.

Referring to FIGS. 3 and 4, operating system 20 includes a cylindrical base member 30 receivable about barrel 14 (illustrated in broken lines), a manifold 32 carried by base member 30, and a piston assembly 34 carried by cylindrical base member 30, adjacent manifold 32. Cylindrical base member 30 is mounted on barrel 14 such that an aperture 35 is formed extending concurrently through barrel 14, base member 30 and manifold 32, providing gaseous communication between barrel 14 and manifold 32. Manifold 32 includes an adjustable plug 36 engaged in the forward end, and a plug 38 threadedly engaged in and closing the rearward end. Aperture 35 is formed proximate the forward end of manifold 32, and another aperture 39 is formed between manifold 32 and piston assembly 34 proximate the rearward end of manifold 32. Adjustable plug 36 is threadedly receivable within and closes the forward end of manifold 32, and is movable longitudinally within manifold 32 to adjust gas flow through aperture 35, either increasing or decreasing the gas flow from barrel 14 into manifold 32.

Piston assembly 34 includes a cylinder 40, a piston 42 and an end plug 43. Cylinder 40 is positioned generally parallel to barrel 14 with aperture 39 forming a communicating passage between manifold 32 and the interior of cylinder 40. End plug 43 is threadedly engaged in and closes the forward end of cylinder 40. Piston 42 is carried within cylinder 40 and includes a hollow piston head 45 with self cleaning grooves 46 formed in piston head 45, to prevent build-up of powder residue such as carbon, engaging an inner surface of cylinder 40. Piston head 45 is open at a forward end and closed at a rearward end by a rod 47 extending from the rearward end. Rod 47 is extendable through an open rearward end of cylinder 40 for purposes that will be described presently. Piston 42 is movable between a retracted position as shown in FIG. 3, and an extended position as shown in FIG. 4. An aperture 48 is formed in piston head 45 proximate the rearward end and aligned with aperture 39 when piston 42 is in the retracted position. A flat surface 49 is formed on rod 47 so as to engage an alignment projection 50 extending from an inner surface of cylinder 40 proximate the open rearward end. The engagement of flat surface 49 and projection 50 maintain radial alignment of piston 42 within cylinder 40 to insure alignment of apertures 39 and 48 in the retracted position.

Starting from the retracted position (see FIG. 3), a cartridge is fired generating gasses that propel a projectile 52 down barrel 14. As projectile 52 passes aperture 35, some of the propelling gasses are diverted into manifold 32, as adjusted by adjustable plug 36. The gasses in manifold 32 pass through aperture 39 and aperture 48, moving piston 42 to the extended position (see FIG. 4). As piston 42 moves into the extended position, rod 47 abuts an end of a push rod 54 and moves push rod 54 in a rearward direction, providing an opening impetus to bolt carrier assembly 15. The length of manifold 32 determines the period of time for gas to flow from aperture 35 to aperture 39. This period of time contributes to a reduction in the cyclic rate of fire of rifle 10.

Thus, increased or decreased rates of fire can be, in part, adjusted by changing the length of manifold 32. This is typically selected during manufacture, but may be made adjustable in specific applications.

Figures 5, 6:
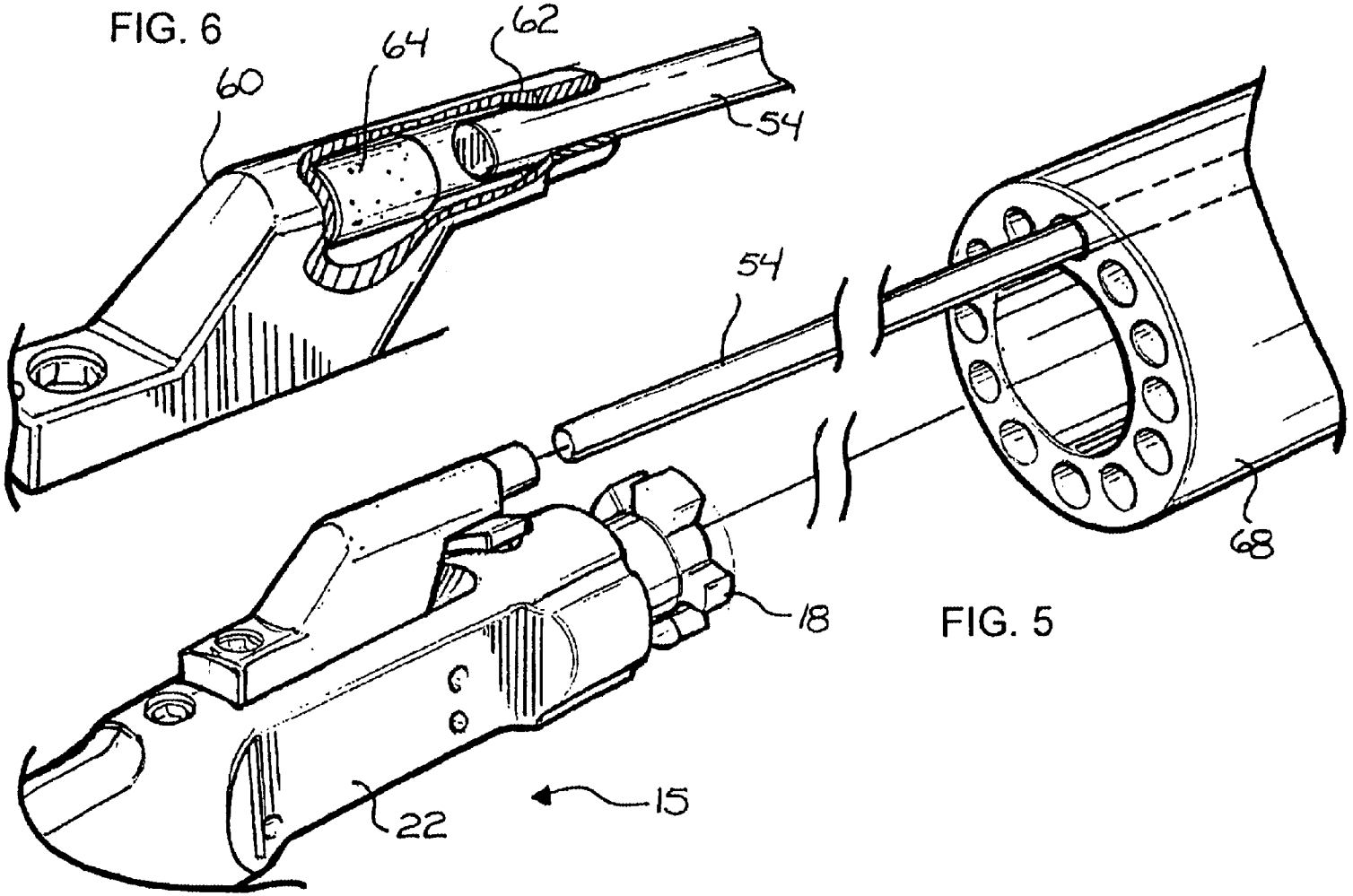
FIG. 5 is a perspective view of another portion of the operating system that mates with the portion illustrated in FIG. 4.
FIG. 6 is an enlarged view similar to FIG. 4, portion thereof broken away and shown in section.
Figure 8:
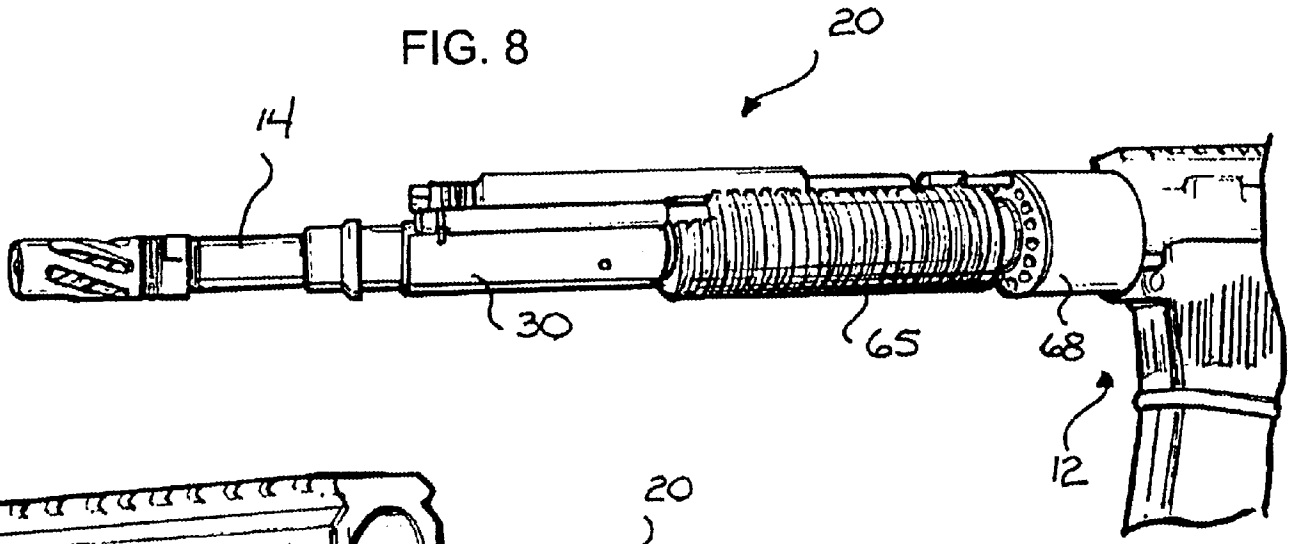
FIG. 8 illustrates the upper receiver and barrel assembly of the rifle with the operating system attached.
Figure 9:
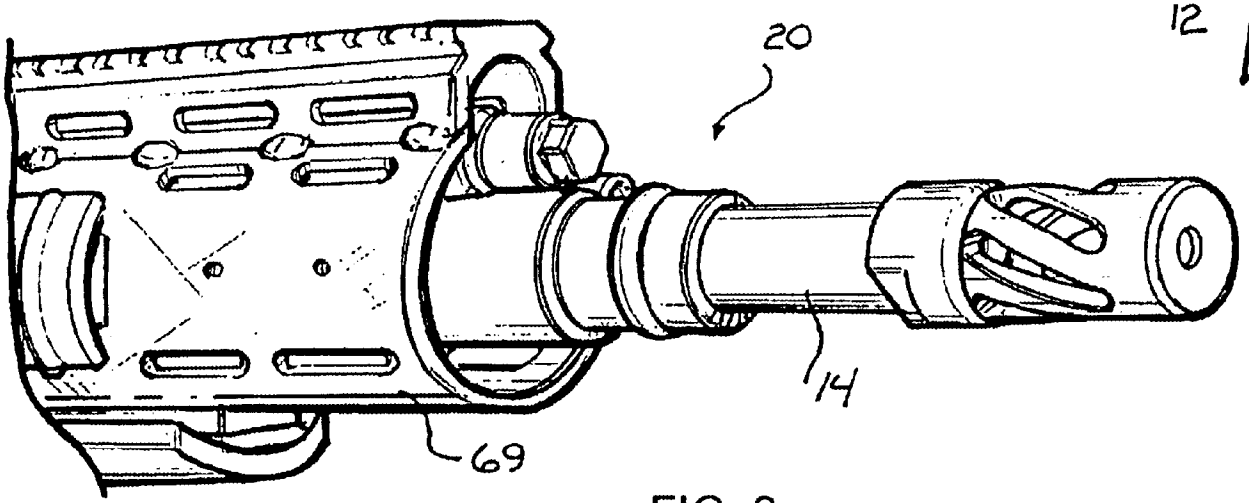
FIG. 9 is an enlarged partial perspective view of a portion of the operating system with handguard attached.

Referring additionally to FIGS. 5 and 6, a rearward end of push rod 54 is received within a drive key 60 (contact point) carried by bolt carrier 22 for moving bolt carrier assembly 15 to an open position. Drive key 60 includes a tubular projection 62 for slidably receiving the rearward end of push rod 54. Tubular projection 62 includes a resilient bumper 64 positioned between the rearward end of push rod 54 and an inner surface of drive key 60. Bumper 64 is constructed to compress slightly from the force of the rearward movement of push rod 54. Bumper 64 can be formed of substantially any resilient material (even a spring), such as urethane and preferably having a durometer of 90. The slight compression momentarily delays and stores a portion of the rearward force. The delay allows pressures within the firing chamber of rifle 10 to fall after firing the cartridge, before rearward movement of bolt carrier assembly 15 occurs. The lower pressures allow easier and less stressful continuation of the firing cycle.

Once the fully extended position of piston 42 has been reached, the firing cycle continues with bolt carrier assembly 15 being moved to a closed position by other elements. The closing action moves push rod 54 in a forward direction, moving piston 42 to the retracted position preparatory to another firing cycle. As piston 42 moves forwardly to the retracted position, gasses within cylinder 40 are exhausted through piston head 45 and out through aperture 48. It should be noted that piston 42 and push rod 54 are separated into two elements in this embodiment (although more can be employed), allowing for some deviation in their alignment. A single push rod can be employed, however the distance between piston head 45 and drive key 60 is substantial, and any distortion of a single rod will cause binding and drag, adversely affecting operation.

Referring to FIG. 7, a heat sink 65 is illustrated for use with rifle 10. Heat sink 65 is an elongated tubular member with a plurality of parallel, circumferentially extending heat exchanging fins 66. A channel 67 is formed in fins 66 along the top of heat sink 65 to accommodate piston assembly 34 and push rod 54. Channel 67 is widened at the forward end of heat sink 65 to permit access to plug 38 for maintenance. Heat sink 65 is formed of a good heat conductive material, preferably aluminum, bonded to barrel 14 using a heat conductive material, such as a ceramic based adhesive, press fit or welded. With additional reference to FIG. 8, heat sink 65 is carried by barrel 14 intermediate base member 30 and a barrel nut 68. Barrel nut 68 couples barrel 14 to upper receiver 12 and includes an aperture through which push rod 54 extends. Barrel nut 68 also carries a hand guard 69 (see FIG. 9) and is described in detail in co-pending U.S. Patent Application entitled "RIFLE HANDGUARD SYSTEM WITH INTEGRATED BARREL NUT" filed 25 Mar. 2002, Ser. No. 10/105,700, herein incorporated by reference. It will be understood that other barrel nuts and hand guards can be employed if desired.

Figure 10:
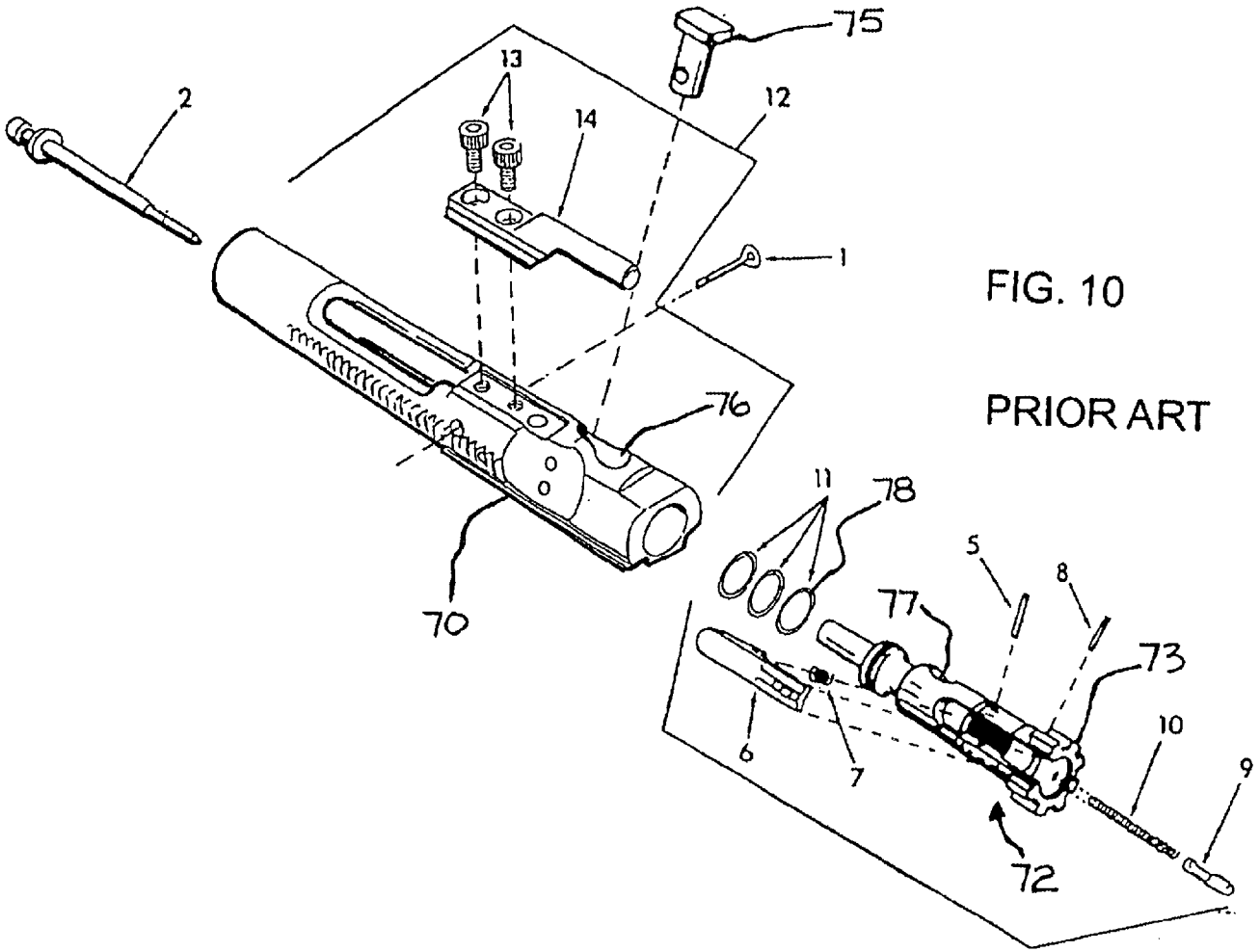
FIG. 10 PRIOR ART
FIG. 10 is an exploded perspective view of a prior art bolt and bolt carrier.

Turning now to FIG. 10, a prior art bolt carrier 70 and bolt 72 are illustrated. FIG. 10 is included to show bolt 72, which is substantially similar to the bolt employed in rifle 10 of the present invention, and the bolt carrier is shown for a comparison with bolt carrier 22 according to the present invention. In operation during a firing cycle, bolt 72 is locked to the barrel in a locked position by lugs 73 rotated in a locking orientation. Upon detonation of a cartridge, gas is directed from the barrel to bolt carrier 70, moving carrier 70 in a rearward direction. A cam pin 75 extends through a cam opening 76 in bolt carrier 70 into an opening 77 in bolt 72. During the initial rearward movement, cam pin 75 is cammed in a rotary movement by cam opening 76, rotating bolt 72 to unlock lugs 73 from the barrel. The continued rearward movement moves bolt 72 and bolt carrier 22 to a fully opened position and extracts the fired casing.

While effective, the gasses entering the mechanism tend to reduce the efficiency of the device and the mechanism must be cleaned frequently. Additionally, while the originally designed rifle worked relatively well, later models that have been shortened have significant drawbacks. By shortening the barrel, the gas tube directing propellant gasses to bolt carrier 70 is shortened, increasing the firing rate. The increased firing rate, or reduced time of the firing cycle, causes extreme stress on various parts of the mechanism. Specifically, if the unlocking of lugs 73 from the barrel and extraction of the spent casing is attempted too early in the cycle, pressures within the firing chamber are very high. The high pressure holds the casing within the chamber and can cause bolt 72 to break, typically at opening 77. Other weak areas are sealing rings 78 carried by bolt 72.

Figure 11:
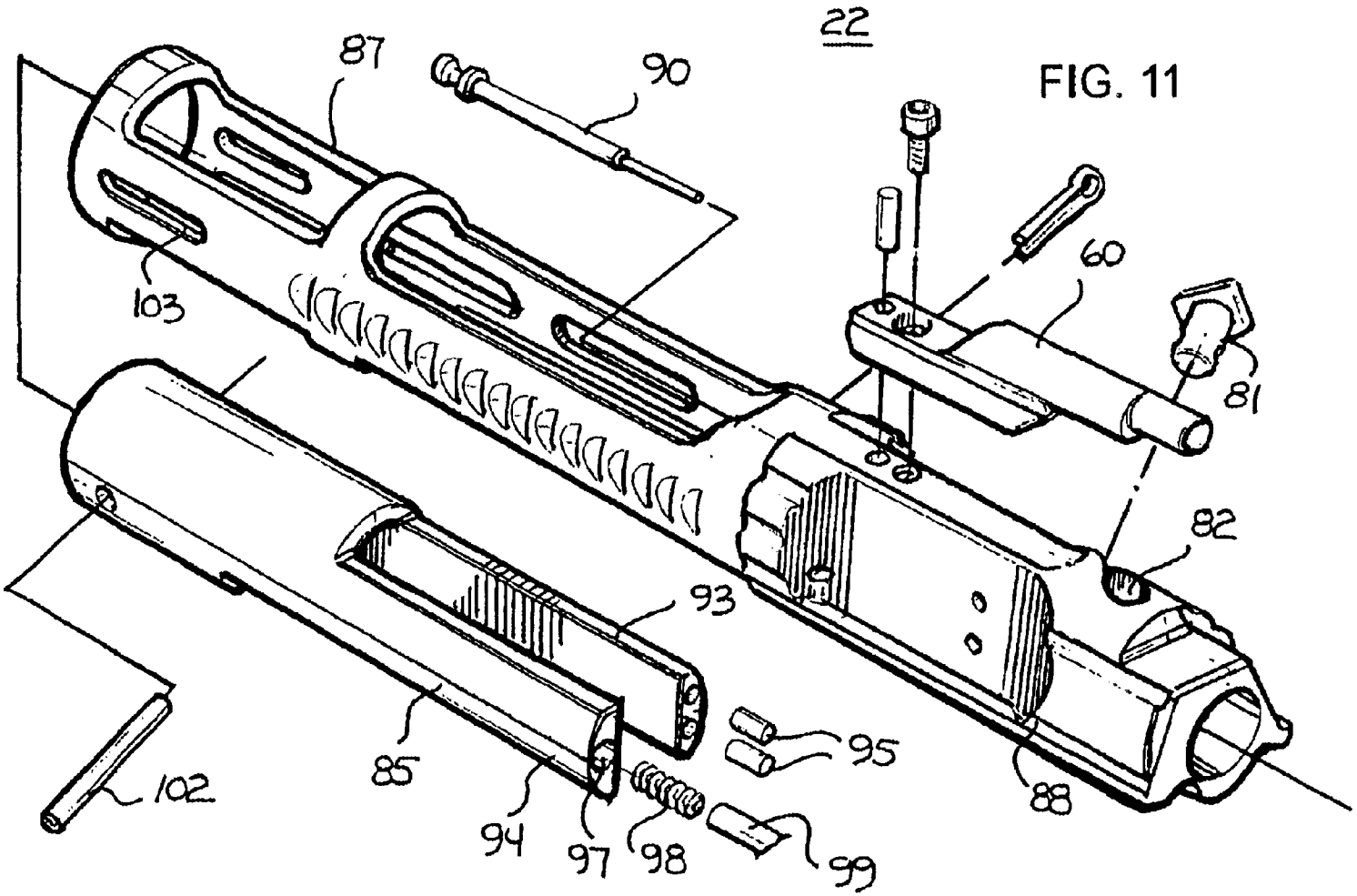
FIG. 11 is an exploded perspective view of a bolt carrier in accordance with the present invention.
Figure 12:
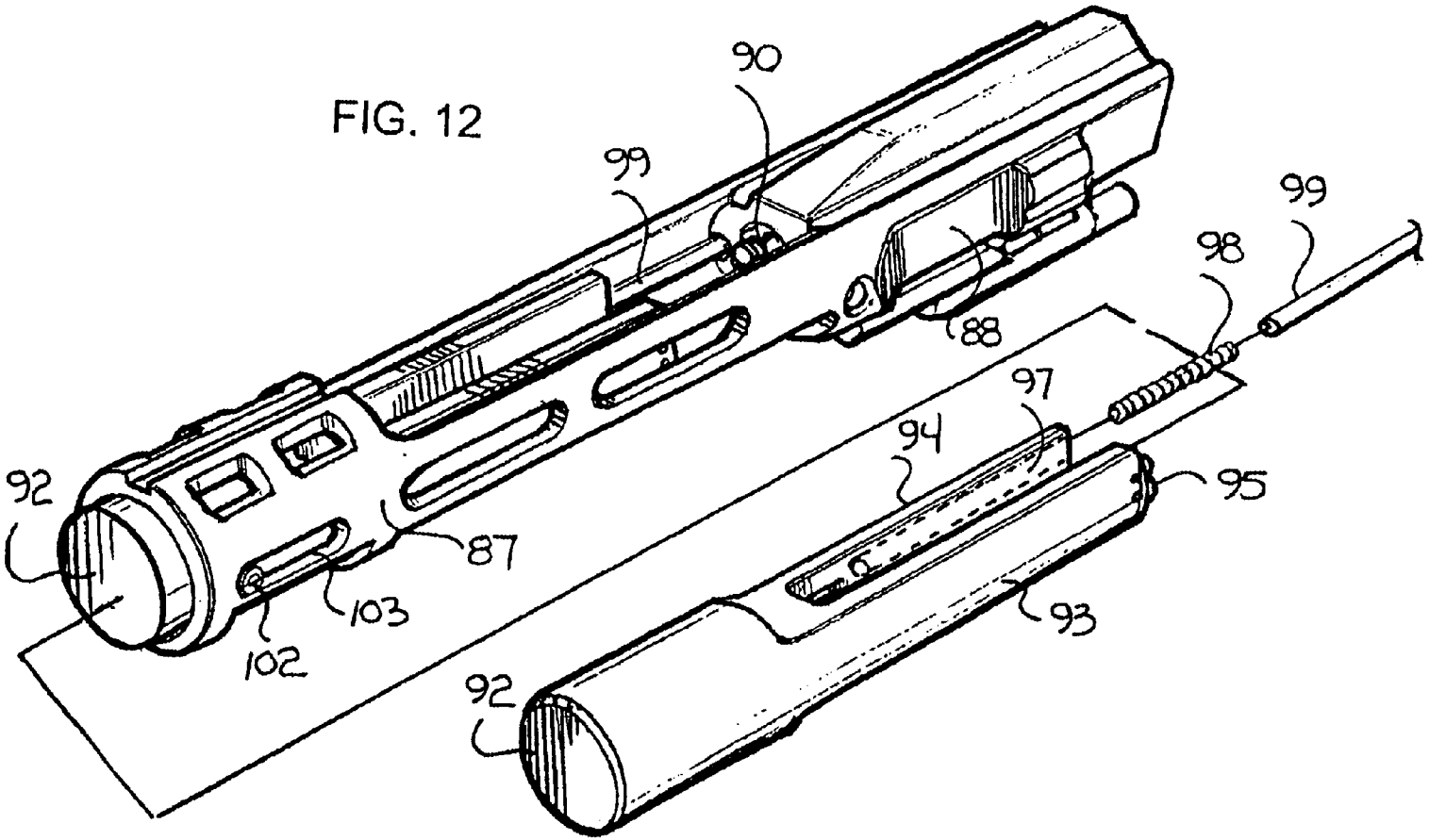
FIG. 12 is an assembly perspective view of the bolt carrier of FIG. 11, inverted to better illustrate the assembly.

Turning now to FIGS. 11 and 12, bolt carrier 22, according to the present invention, is illustrated. Bolt carrier 22 carries a bolt 80 (see FIGS. 1 and 5), and includes a cam pin 81 riding within a cam opening 82 that operate in a conventional manner, as briefly described above. Bolt 80 is a conventional bolt operated in a similar manner, and will not be described in further detail. Bolt carrier 22 is modified from existing bolt carriers by the addition of a reciprocating weight 85. Weight 85 is carried within a rearward portion of bolt carrier 22, which is formed into a tubular guide frame 87. A forward portion 88 of bolt carrier 22 carries bolt 80 and firing pin 90.

Weight 85 is cylindrical with a rearward end defining a surface 92 and a forward end, which in this embodiment is bifurcated to define a branch 93 and a branch 94. Branch 93 includes one or more bumpers 95 formed of a resilient material to absorb contact energy from forward portion 88. Bumpers 95 can be attached to the forward surface of branch 93 or set within mating openings, etc. Branch 94 includes a receptacle 97 extending from a forward surface thereof longitudinally into branch 94 to allow a biasing member such as a spring 98 and a locator rod 99 to be contained therein with locator rod 99 contacting forward portion 88. Locator rod 99 can be forced into receptacle 97 against the bias of spring 98 a distance sufficient to permit bumpers 95 to contact forward portion 88. One skilled in the art will understand that bumpers 95 and locator rod 99 can be interchanged between branches 93 and 94.

Weight 85 has a starting position, which is at a rearward limit within guide frame 87, and a forward position, which is at a forward limit wherein bumpers 95 contact forward portion 88. Locator rod 99 biases weight 85 rearwardly toward the starting position. A limit pin 102 is carried within an aperture extending through weight 85 proximate the rearward end. Guide frame 87 has guide slots 103 formed on opposing sides to receive ends of limit pin 102 extending from weight 85. Limit pin 102 prevents rotation of weight 85, and limits the rearward movement thereof.

In operation, upon firing rifle 10, bolt carrier 22 is moved in the rearward direction by push rod 54 acting on drive key 60. Weight 85 has a resting inertia that causes it to move forward relative to bolt carrier 22 into the forward position. In other words, as bolt carrier 22 moves rearwardly, weight 85 remains substantially stationary with locator rod 99 being urged into receptacle 97 against the bias of spring 98, absorbing some of the forces generated by firing the cartridge (firing forces). Upon weight 85 reaching the forward position, bumpers 95 contact forward portion 88, again absorbing some of the firing forces. As carrier 22 continues in the rearward direction some of the firing forces are used to start weight 85 in a rearward direction, and are conserved as inertia of weight 85.

A buffer system located within butt stock 18, which may be a prior art buffer system or buffer system 24 to be described presently, cooperates with bolt carrier 22 and weight 85 to continue the firing cycle. As bolt carrier 22 moves rearwardly, it is in contact with and compresses the buffer system. Thus, the buffer system absorbs firing forces, and utilizes the forces to complete the firing cycle by moving bolt carrier 22 in a forward direction, stripping the next cartridge from a magazine and continuing forward to lock bolt 80 to barrel 14. Because of the inertia of weight 85, as bolt carrier 22 moves forward, weight 85 lags behind until it reaches the rearward limit, which is the start position. Weight 85, while in the start position, is still moving with bolt carrier 22 in a forward direction. When bolt carrier 22 reaches the forward or locked position, it is ready to fire another cartridge. Because of the inertia of weight 85 it continues moving in the forward direction. Upon firing another cartridge soon after firing the initial cartridge, such as in a fully automatic mode, bolt carrier 22 will again move rearwardly as described in the previous cycle, but weight 85 has not yet reached the forward position. As bolt carrier 22 moves rearwardly and weight 85 moves forwardly, bumpers 95 contact forward portion 88. Thus, the firing forces conserved by weight 85 and converted to its forward momentum, are expended to cancel part of the firing forces of the next firing cycle. At this point, weight 85 begins a second cycle as described in the first cycle.

It should be noted that an additional improvement provided by the embodiment illustrate in FIG. 11, is a shortening of drive key 60 to permit additional space for allowing rearward movement of bolt carrier 22. Specifically in the preferred embodiment, ¼ inch of the rear end of drive key 60 is removed to permit an additional 1 inch of travel of bolt carrier 22. The additional distance permits a larger margin for the ejection of a spent cartridge and receipt of the next cartridge and provides a fraction more time for the next cartridge in the magazine to move into position.

Figure 13:
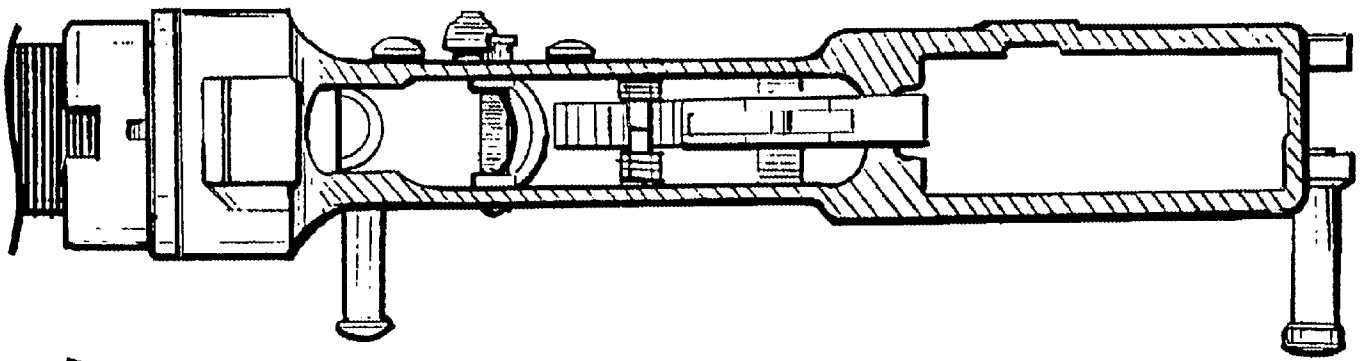
FIG. 13 is a top view of the lower receiver.
Figure 14:
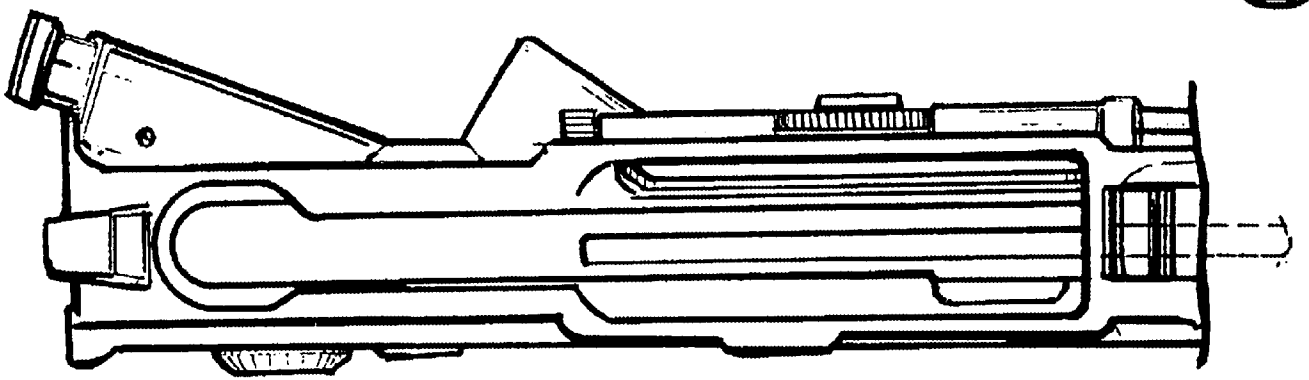
FIG. 14 is a bottom view of the upper receiver.

Referring to FIG. 13, a top view of the lower receiver is shown. In FIG. 14 a bottom view of the upper receiver is shown. These views are included to illustrate various components and their relative orientation of rifle 10, generally similar to components of the prior art, not described in detail.

Figure 15:
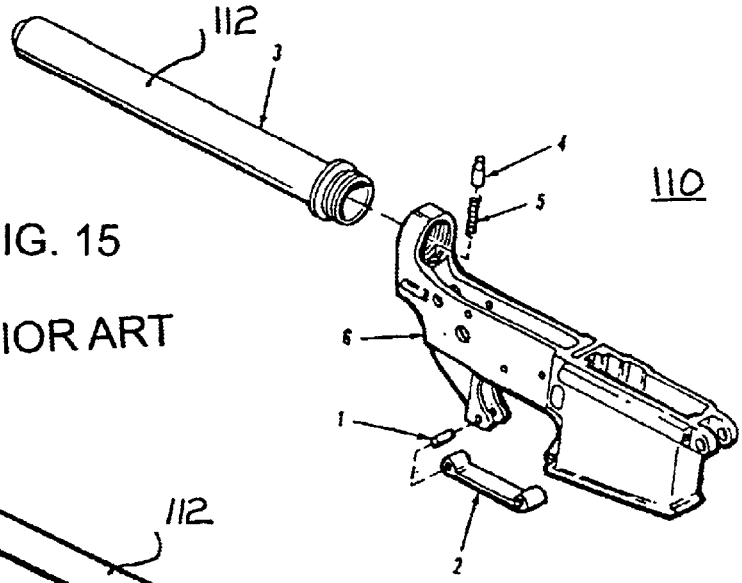
FIG. 15 PRIOR ART
FIG. 15, 16 and 17 are perspective views illustrating exploded perspective views of a prior art buffer system.
Figure 16:
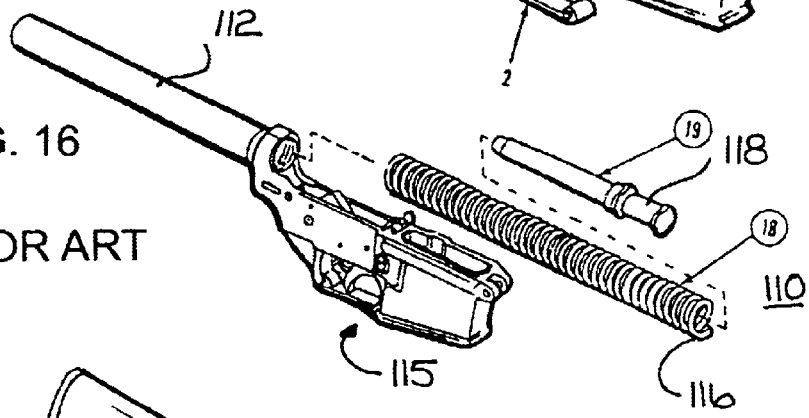
FIG. 16 PRIOR ART
Figure 17:
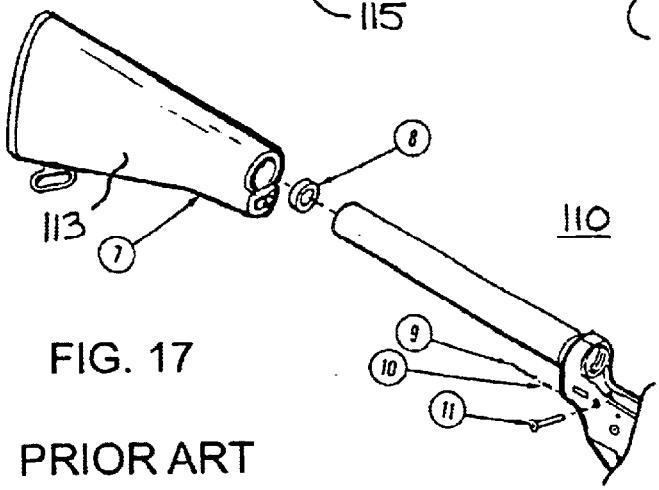
FIG. 17 PRIOR ART

Turning now to FIGS. 15–17, perspective exploded views are provided illustrating a prior art buffer system 110. Buffer system 110 includes an elongated hollow cylinder 112 designed to be received within a butt stock 113. A forward end of cylinder 112 is attached to a lower receiver 115 and is open to receive a buffer compression spring 116 therein. An elongated weight 118 is constructed to fit within compression spring 116 with a forward end contacting the bolt carrier (not shown). As the bolt carrier is forced rearwardly by firing a cartridge, weight 118 is forced rearwardly and compresses spring 116. The combination of overcoming the inertia of weight 118 and compressing spring 116 absorbs firing forces generated by the firing of the cartridge. The absorbed forces are stored by the spring and converted to a forward movement of the bolt carrier by re-expansion of the spring.

Figure 18:
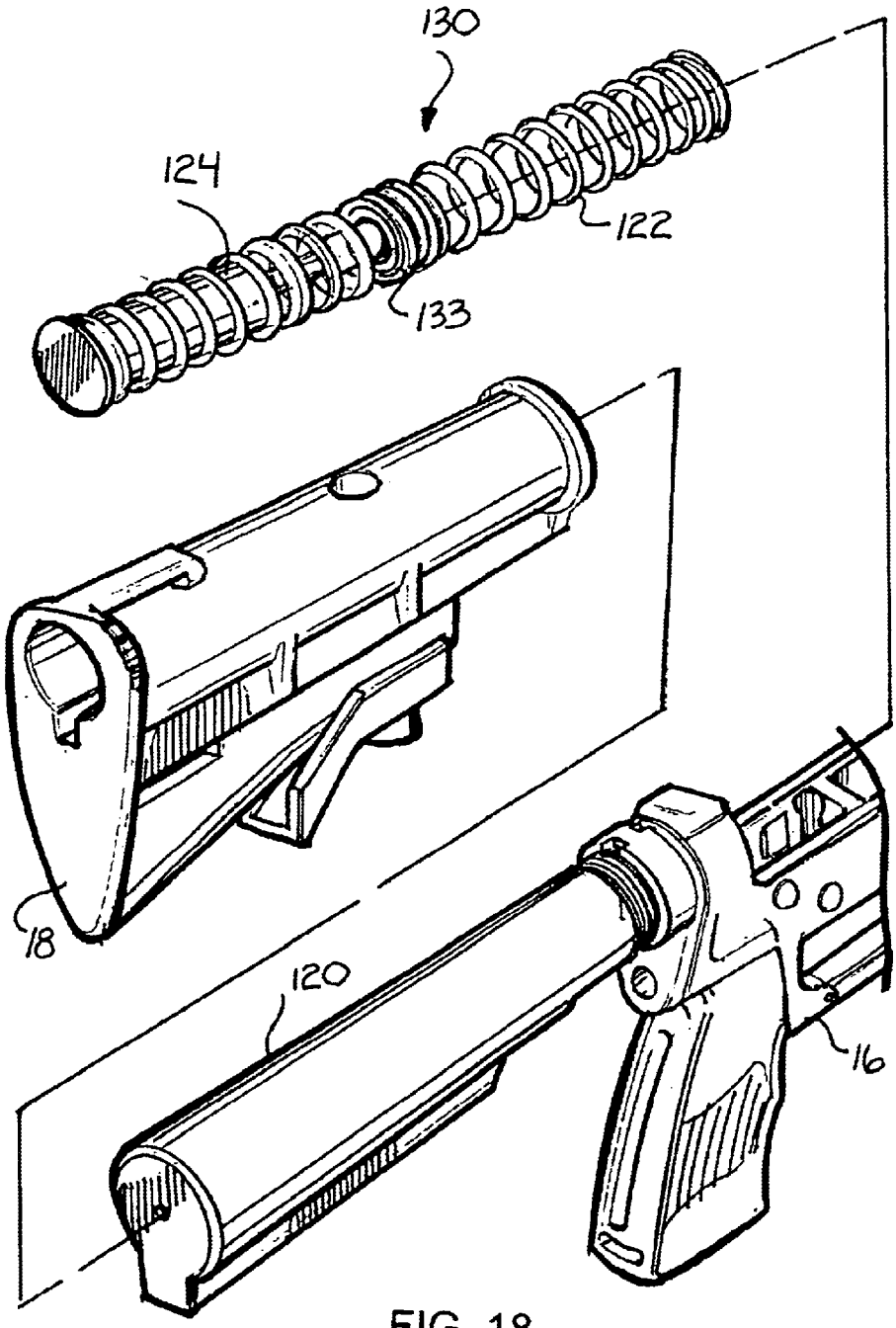
FIG. 18 is a partial exploded perspective view illustrating a buffer system and butt stock according to the present invention.
Figure 19:
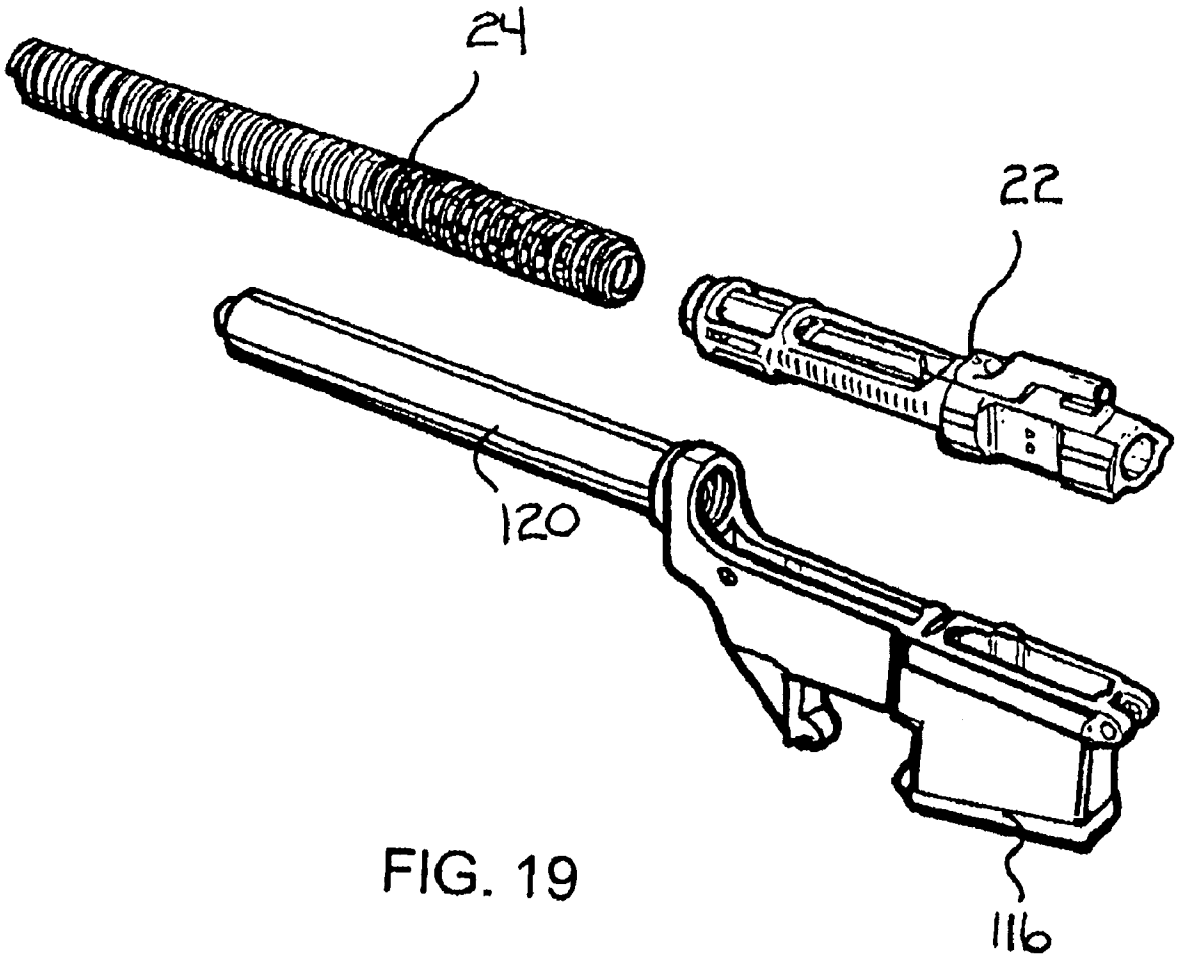
FIG. 19 is an exploded perspective view illustrating relative positioning of the buffer system and butt stock of FIG. 18 and the bolt carrier of FIG. 11.

Turning now to FIGS. 18–23, buffer system 24 according to the present invention is illustrated in detail. It will be understood that buffer system 24 can be used alone with the prior art (e.g., in place of the buffer system illustrated in FIGS. 15–17) or in combination with any of the preceding modifications. Referring specifically to FIG. 18, a butt stock 18 is illustrated for attachment to a tubular extension member 120. Extension member 120 allows adjustment of butt stock 18 and contains buffer system 24. Extension member 120 is threadedly coupled to lower receiver 16 with buffer system 0.24 aligned with bolt carrier 22 as shown in FIG. 19.

Buffer system 24 includes an elongated compression spring 122 and a piston assembly 124 carried therein. Piston assembly 124 has a partially fluid filled cylinder 125 attached to a coil, which in this embodiment is a forward end 126, of spring 122 and a piston 128 carried by a shaft 129 within cylinder 125. Shaft 129 extends rearwardly coaxially within spring 122 and terminates in an anchor portion 130. Anchor portion 130 includes a spring engaging ring 132 (best seen in FIG. 21) designed to be positioned within spring 122 at substantially a median coil 133 thereon and a connecting member 134 configured to engage a shoulder of ring 132 during expansion of spring 122, but free to pass through ring 132 during compression of spring 122. Connection member 134 is preferably constructed of a resilient material such as urethane. A rearward end of shaft 129 is received by and coupled to connecting member 134, to expand piston assembly 124 from a point in fixed relationship with turn 133. Spring 122 is compressible rearward of turn 133 and is also compressible forward of turn 133 with compression of piston assembly 124. Piston assembly 124 also includes a reciprocating weight 136 carried by shaft 129 intermediate anchor portion 130 and cylinder 125. Weight 136 is biased rearwardly toward connection member 134 by a compression spring 138 positioned coaxially around shaft 129 between weight 136 and cylinder 125. A bumper member 137 formed of an elastomeric or resilient material in a ring shape, is carried in a groove formed in the forward end of cylinder 125, to receive and absorb a portion of the force from contact with bolt carrier 22. Bumper member 137 is positioned to contact both the rearward end of guide frame 87 and reciprocating weight 92.

Figures 20, 21, 22, 23:
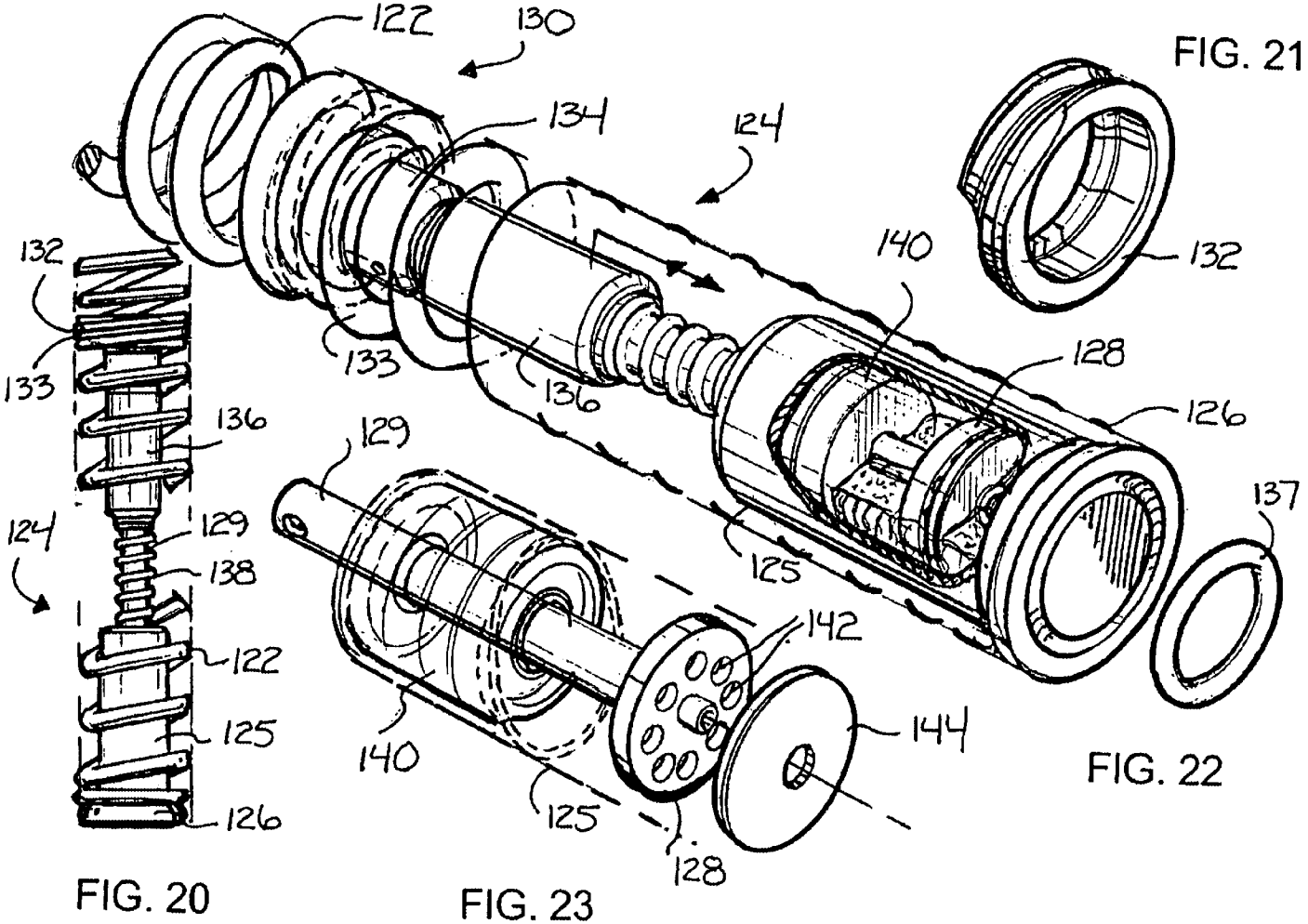
FIG. 20 is a side elevation view of the buffer system, portions thereof broken away.
FIG. 21 is an enlarged perspective view of a spring engaging element of the buffer system.
FIG. 22 is an enlarged perspective view of the buffer system with portion broken away and shown in section.
FIG. 23 is a perspective view of a portion of the buffer system of FIG. 22.

With additional reference to FIG. 23, a packing seal 140 is positioned within cylinder 125 at a rearward end, to provide a fluid seal around shaft 129, allowing reciprocating movement of shaft 129. A forward end of shaft 129 carries piston 128, which moves within cylinder 125 when the portion of spring 122 forward of turn 133 is compressed. Piston 128 has a plurality of holes 142 formed axially therethrough for the limited passage of fluid as piston 128 is moved through the fluid in cylinder 125. A flapper valve 144 is affixed to piston 128 coaxially over shaft 129 so as to lie over the forwardly facing surface of piston 128 and holes 142.

Thus, as piston 128 is forced forward (to the right in FIGS. 22 and 23) in cylinder 125 holes 142 are closed by flapper valve 144 and fluid must travel around the outer edges of piston 128. This limits the flow of fluid and substantially slows the movement of piston 128. As spring 122 reaches the extent of its compression and begins to expand, piston 128 moves in a rearward direction (to the left in FIGS. 22 and 23). Fluid in cylinder 125 now flows through holes 142, since flapper valve 144 is in a non-restricting position and piston 128 moves substantially freely. Thus, movement of piston 128 is substantially restricted in the forward direction (compression of spring 122) and substantially unrestricted in the rearward direction (expansion of spring 122). It will also be noted that spring 122 is positioned in tubular extension member 120 so that the rear end of bolt carrier 22 abuts forward end 126 of spring 122. Therefore, immediately after the firing of a cartridge the rearward movement of bolt carrier 22 compresses spring 122. When spring 122 is near full compression, anchor portion 130 contacts the end wall of extension member 120, forcing piston 128 toward the forward end of cylinder 125. The restricted movement of piston 128 in the forward direction tends to absorb more of the shock generated by the propelling gases during the firing cycle while the substantially unrestricted movement of piston 128 in the rearward direction allows piston 128 to more quickly return to an at-rest position. Piston 128 is moved in the rearward direction by the expansion of compression spring 122. As spring 122 expands, connection member 134 engages ring 132 and pulls on shaft 129 returning piston assembly 124 to its extended position.

Also, the at-rest inertia of reciprocating weight 136 of buffer system 124 causes weight 136 to be initially forced forward, relative to the rearward movement of shaft 129 by the rearward movement of bolt carrier 22, and against the bias of spring 138. This movement of weight 136 and consequent compression of spring 138 essentially absorbs and stores energy produced by propellant gases during the firing cycle. The combination of overcoming the inertia of weight 136 and compressing spring 138 absorbs firing forces generated by the firing of the cartridge. The absorbed forces are stored by both the inertia of weight 136 and compression of spring 138 and converted to a forward movement of the bolt carrier by re-expansion of the spring.

Turning now to rifle 10 of FIG. 1 and referring additionally to the drawings of the various modifications discussed above, the operation of rifle 10 with all of the modifications involved will be explained. Assume that an initial cartridge is chambered in barrel 14 with bolt 80 locked in place, bolt carrier 22 in a closed position, and all of the various components in an at-rest position. The trigger is operated and projectile 52 is sent down barrel 14 by the resulting propellant gases. The propellant gases enter manifold 32 and piston assembly 34, forcing pushrod 54 against drive key 60. Drive key 60 forces bolt carrier 22 rearwardly, ejecting the spent shell casing from barrel 14.

Weight 85 in bolt carrier 22 has a resting inertia that causes it to move forward relative to bolt carrier 22 into the forward position. In other words, as bolt carrier 22 moves rearwardly, weight 85 remains substantially stationary. Locator rod 99 is urged into receptacle 97 against the bias of spring 98, absorbing some of the forces generated by firing the cartridge (firing forces). Upon weight 85 reaching the forward position, bumpers 95 contact forward portion 88, again absorbing some of the firing forces. As carrier 22 continues in the rearward direction some of the firing forces are used to start weight 85 in a rearward direction, and is conserved as inertia of weight 85.

The rearward movement of bolt carrier 22 abutting buffer system 24 also compresses spring 122 of buffer system 24. Compression of spring 122 ultimately moves piston 128 forward in cylinder 125 when connection member 134 contacts the back of extension member 120, with the movement being suppressed by the liquid in cylinder 125, which absorbs more of the firing forces. Also, weight 136, which has a resting inertia that causes it to move forward relative to shaft 129, ultimately moves into the forward position against the bias of compression spring 138. Moving weight 136 against its inertia and compressing spring 138 absorbs more of the firing forces The result is that a substantial amount of the initial firing forces are absorbed so that little force is ultimately transmitted to butt stock 18.

Once bolt carrier 22 reaches its maximum rearward or open position, spring 122 begins to expand and urge bolt carrier 22 back toward the closed position. Each reciprocating weight 85 (in bolt carrier 22) and 136 (in buffer system 24) is now started forward against their inertia, using up some of the force of compression spring 122, however, piston 128 moves more freely because flapper valve 144 allows the fluid to flow through holes 142. Thus, there is less resistance and the next round is stripped from the magazine and chambered in barrel 14 as bolt 80 is locked in place. The movement of bolt carrier 22 toward the locked position moves pushrod 54 against piston 42 toward the retracted position, which forces out any gases remaining in cylinder 40.

Assuming that rifle 10 is being fired in the automatic mode, once the next cartridge is loaded and locked in place it is fired. The above described cycle repeats, except that the design of the components is such that reciprocating weights 85 and 136 are still moving and have not yet reached the maximum or at-rest positions. In other words, weights 85 and 136 still have stored some of the energy absorbed from the previous firing. Now as bolt carrier 22 is moved in a rearward direction by the propellant gases from the next cartridge fired, weights 85 and 136 are moving forward and extra energy from the firing forces is absorbed in overcoming the stored energy as well as the inertia described above. Thus, part of the energy from the previous cartridge fired is stored and used to offset some of the energy generated during the next firing. The result is that an even larger amount of the firing forces are absorbed, during firings subsequent to the initial firing in the automatic mode so that even less force is ultimately transmitted to butt stock 18.

Thus, a new and improved automatic/semi-automatic rifle is disclosed which is more reliable because it uses a positive acting pushrod assembly, rather than a gas ejection system. Also, the new and improved automatic/semi-automatic rifle is designed with improved timing in the firing cycle so that shortening or other changes have little or no effect on the firing rate and, hence, on the operation. Further, the new and improved automatic/semi-automatic rifle includes improved shock absorbing characteristics that substantially reduce the recoil effects of firing. Also, the new and improved automatic/semi-automatic rifle includes an improved heat sink so that the rifle can be fired for longer periods without adverse effects.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. In a rifle having an upper receiver carrying a bolt carrier and a barrel attached to the upper receiver, an operating system comprising:

a bolt carrier having a forward portion carrying a bolt with firing pin and a tubular guide frame extending rearwardly therefrom, and a reciprocating weight carried within the tubular guide frame rearward of the forward portion for movement between a first position at a rearward limit and a second position at a forward limit;

a piston assembly coupled to the barrel for receiving propelling gasses from the barrel, the piston assembly including a piston moveable between a retracted position and an extended position;

the piston being coupled to the bolt carrier for movement of the bolt carrier from a closed position to an open position as the piston moves from the retracted position to the extended position; and a resilient member positioned between the piston and the bolt carrier for delaying and storing a portion of force generated by the propelling gases.

2. In a rifle having an upper receiver carrying a bolt carrier and a barrel attached to the upper receiver, an operating system as claimed in claim 1 further including a plurality of elements coupling the piston to the bolt carrier.

3. In a rifle having an upper receiver carrying a bolt carrier and a barrel attached to the upper receiver, an operating system as claimed in claim 1 wherein the bolt carrier includes a drive point receiving the piston, the drive point carrying the resilient member therein.

4. In a rifle having an upper receiver carrying a bolt carrier and a barrel attached to, the upper receiver, a bolt carrier as claimed in claim 1 further including at least one resilient bumper attached to the reciprocating weight for butting against a surface of the forward portion of the bolt carrier when the reciprocating weight is moved from the first position to the second position to absorb contact energy from the forward portion.

5. In a rifle having an upper receiver carrying a bolt carrier and a barrel attached to the upper receiver, as claimed in claim 1 wherein the bolt carrier has a locked position and an open position, a buffer system comprising:

an elongated compression spring positioned in a tubular extension member having a closed end, and an open end attached to the lower receiver so as to be in abutting engagement with the bolt carrier;

a partially fluid filled cylinder fixedly attached to a first coil of the spring;

a piston reciprocally mounted within the cylinder for movement between a first position and a second position, the piston including a connecting shaft having an end contacting the closed end of the extension member upon compression of the spring and spaced from the closed end of the extension member upon expansion of the spring, the piston being formed so that the fluid in the cylinder restricts movement of the piston toward the first position and allows substantially free movement of the piston toward the second position; and the piston being mounted so that compression of the spring by movement of the bolt carrier from the locked position to the open position moves the piston in the cylinder toward the first position and expansion of the spring moves the bolt carrier from the open position to the locked position and moves the piston in the cylinder toward the second position.

6. In a rifle having an upper receiver carrying a bolt carrier and a barrel attached to the upper receiver, as claimed in claim 5 wherein the buffer system further includes a ring fixedly coupled to a second coil of the spring spaced from the first coil, the ring engaging the end of the connecting shaft during expansion of the spring and permitting movement of the end during compression of the spring.

7. In a rifle having an upper receiver carrying a bolt carrier and a barrel attached to the upper receiver an operating system comprising:

a piston assembly coupled to the barrel for receiving propelling gasses from the barrel, the piston assembly including a piston moveable between a retracted position and an extended position;

the piston being coupled to the bolt carrier for movement of the bolt carrier from a closed position to an open position as the piston moves from the retracted position to the extended position;

a resilient member positioned between the piston and the bolt carrier for delaying and storing a portion of force generated by the propelling gases; and a buffer system comprising:

an elongated compression spring positioned in a tubular extension member having a closed end, and an open end attached to the lower receiver so as to be in abutting engagement with the bolt carrier;

a partially fluid filled cylinder fixedly attached to a first coil of the spring;

a piston reciprocally mounted within the cylinder for movement between a first position and a second position, the piston including a connecting shaft having an end contacting the closed end of the extension member upon compression of the spring and spaced from the closed end of the extension member upon expansion of the spring, the piston being formed so that the fluid in the cylinder restricts movement of the piston toward the first position and allows substantially free movement of the piston toward the second position; and the piston being mounted so that compression of the spring by movement of the bolt carrier from a locked position to an open position moves the piston in the cylinder toward the first position and expansion of the spring moves the bolt carrier from the open position to the locked position and moves the piston in the cylinder toward the second position.

8. In a rifle having an upper receiver carrying a bolt carrier and a barrel attached to the upper receiver, as claimed in claim 7 wherein the buffer system further includes a ring fixedly coupled to a second coil of the spring spaced from the first coil, the ring engaging the end of the connecting shaft during expansion of the spring and permitting movement of the end during compression of the spring.

9. In a rifle having an upper receiver carrying a bolt carrier and a barrel attached to the upper receiver, an operating system comprising:

a piston assembly coupled to the barrel for receiving propelling gasses from the barrel, the piston assembly including a piston moveable between a retracted position and an extended position;

a push rod extending along the barrel and having a first end positioned to be engaged by the piston and a second end coupled to the bolt carrier for movement of the bolt carrier from a closed position to an open position as the piston moves from the retracted position to the extended position; and a resilient member positioned between the second end of the push rod and the bolt carrier for delaying and storing a portion of force generated by the propelling gases.

10. In a rifle having an upper receiver carrying a bolt carrier and a barrel attached to the upper receiver, an operating system as claimed in claim 9 wherein the bolt carrier includes a drive point receiving the second end of the push rod, the drive point carrying the resilient member therein.

* * * * *